US008129311B2

(12) United States Patent
Koide et al.

(10) Patent No.: US 8,129,311 B2
(45) Date of Patent: Mar. 6, 2012

(54) HEAT-SENSITIVE TRANSFER IMAGE-RECEIVING SHEET

(75) Inventors: Tomoyuki Koide, Minato-ku (JP); Ryuji Shinohara, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 486 days.

(21) Appl. No.: 12/360,479

(22) Filed: Jan. 27, 2009

(65) Prior Publication Data

US 2009/0197024 A1 Aug. 6, 2009

(30) Foreign Application Priority Data

Jan. 28, 2008 (JP) ..... 2008-016964

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 5,529,972 A * 6/1996 Ramello et al. ..... 503/227

FOREIGN PATENT DOCUMENTS

| | | | | |
|---|---|---|---|---|
| JP | 10-129135 | A | | 5/1998 |
| JP | 2000-135862 | A | | 5/2000 |
| JP | 2000-238440 | | * | 9/2000 |
| JP | 2003-200669 | A | | 7/2003 |
| JP | 2005-313383 | A | | 11/2005 |
| JP | 2006-082382 | A | | 3/2006 |
| JP | 2006-088691 | A | | 4/2006 |
| JP | 2007-190909 | A | | 8/2007 |
| JP | 2008-006789 | A | | 1/2008 |

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet, containing a support and an interlayer, an insulation layer and a receptor layer formed on the support in that order, wherein the receptor layer contains at least one kind of latex polymer and a compound represented by the following Formula (I) or an inorganic salt, and the contact angle between the receptor layer surface and water 2 seconds after placement of water droplet, as determined by the static droplet method specified in JIS R-3257, is 68° or less or the contact angle 60 seconds after placement of water droplet is 28° or less, $$R—(OCH_2CH_2)_n—OH \qquad \text{Formula (I)}$$

wherein, R represents an alkyl or alkenyl group having 4 to 30 carbon atoms, and n is an integer of 10 to 30.

9 Claims, No Drawings

HEAT-SENSITIVE TRANSFER IMAGE-RECEIVING SHEET

FIELD OF THE INVENTION

The present invention relates to a heat-sensitive transfer image-receiving sheet, in particular to a heat-sensitive transfer image-receiving sheet resistant to browning in the high-density region of near-black image and deterioration in glossiness of the transferred image after printing under high-humidity environment.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography which is a system with treatment chemicals, and it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

Recently, printers in thermal transfer recording process are becoming more popular, because of their convenience in handling and high-quality image. These printers are used under various temperature and humidity environments.

For reduction in environmental load, heat-sensitive transfer image-receiving sheets produced by aqueous coating, for example those containing a latex polymer in a receptor layer, were proposed (see JP-A-2006-88691 ("JP-A" means unexamined published Japanese patent application), JP-A-2006-82382 and JP-A-2007-190909), but these heat-sensitive transfer image-receiving sheets caused additional problems, for example, of browning in the high-density region of near-black image and deterioration in glossiness after printing under high-humidity environment.

Presence of water at the interface between the heat-sensitive transfer sheet and the heat-sensitive transfer image-receiving sheet during printing often exerts such an influence, and the influence is particularly distinctive in these heat-sensitive transfer image-receiving sheets prepared by aqueous coating.

Therefore, there exists a strong need for means to overcome the problems.

SUMMARY OF THE INVENTION

The present invention resides in a heat-sensitive transfer image-receiving sheet, comprising a support and an interlayer, an insulation layer and a receptor layer formed on the support in that order, wherein the receptor layer contains at least one kind of latex polymer and a compound represented by the following Formula (I) or an inorganic salt, and the contact angle between the receptor layer surface and water 2 seconds after placement of water droplet, as determined by the static droplet method specified in JIS R-3257, is 68° or less or the contact angle 60 seconds after placement of water droplet is 28° or less, $$R—(OCH_2CH_2)_n—OH \qquad \text{Formula (I)}$$

wherein R represents an alkyl or alkenyl group having 4 to 30 carbon atoms, and n is an integer of 10 to 30.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising a support and an interlayer, an insulation layer and a receptor layer formed on the support in that order, wherein the receptor layer contains at least one kind of latex polymer and a compound represented by the following Formula (I) or an inorganic salt, and the contact angle between the receptor layer surface and water 2 seconds after placement of water droplet, as determined by the static droplet method specified in JIS R-3257, is 68° or less or the contact angle 60 seconds after placement of water droplet is 28° or less, $$R—(OCH_2CH_2)_n—OH \qquad \text{Formula (I)}$$

wherein, R represents an alkyl or alkenyl group having 4 to 30 carbon atoms, and n is an integer of 10 to 30.

(2) The heat-sensitive transfer image-receiving sheet according to the above item (1), wherein the contact angle 2 seconds after placement of water droplet is 68° or less and the contact angle 60 seconds after placement of water droplet is 28° or less.

(3) The heat-sensitive transfer image-receiving sheet according to the above item (1) or (2), wherein the receptor layer contains the compound represented by the formula (I).

(4) The heat-sensitive transfer image-receiving sheet according to any one of the above items (1) to (3), comprising the compound represented by the formula (I) in an amount of 0.03 $g/m^2$ to 0.3 $g/m^2$.

(5) The heat-sensitive transfer image-receiving sheet according to the above item (1) or (2), wherein the receptor layer contains the inorganic salt.

(6) The heat-sensitive transfer image-receiving sheet according to any one of the above items (1), (2) and (5), wherein the inorganic salt is contained in an amount of 0.01 $g/m^2$ to 0.9 $g/m^2$.

(7) The heat-sensitive transfer image-receiving sheet according to any one of the above items (1) to (6), wherein the latex polymer is one or at least two kinds of latex polymer selected from vinyl chloride/acrylic compound latex copolymers, vinyl chloride/vinyl acetate latex copolymers, and vinyl chloride/vinyl acetate/acrylic compound latex copolymers.

(8) The heat-sensitive transfer image-receiving sheet according to any one of the above items (1) to (7), wherein the heat insulation layer contains at least one kind of hollow polymer particles.

(9) The heat-sensitive transfer image-receiving sheet according to any one of the above items (1) to (8), wherein the interlayer contains a water-soluble polymer other than gelatin.

(10) The heat-sensitive transfer image-receiving sheet according to any one of the above items (1) to (9), wherein the heat insulation layer contains at least one kind of hollow polymer particles, and the heat-sensitive transfer image-receiving sheet is formed by simultaneous multilayer coating of the interlayer, the heat insulation layer and the receptor layer.

The present invention is explained in detail below.

The heat-sensitive transfer image-receiving sheet of the present invention (hereinafter also referred to as "the image-receiving sheet of the present invention") preferably has, on a support, at least one an interlayer, at least one heat insulation layer (hereinafter also referred to as "porous layer"), and at least one receptor layer (hereinafter also referred to as "ink receptor layer" or "dye receptor layer") in this order. As the interlayer, an interlayer having various functions such as white back ground controlling, antistatic, adhesion, and leveling functions is preferable. Further, a release layer may be formed at the outermost layer on the side of which a heat-sensitive transfer sheet is superposed.

Favorably in the present invention, the receptor layer contains at least one latex polymer and is prepared by aqueous coating; and the interlayer and the heat insulation layer are also prepared by aqueous coating. Each of these layers is applied using a common method, such as a roll coating, a bar coating, a gravure coating, a gravure reverse coating, a die coating, a slide coating and a curtain coating. Each of the receptor layer, the heat insulation layer and the interlayer may be individually coated. Alternatively, a combination of any of these layers may be applied by simultaneous multilayer coating. It is especially preferred that mutually adjacent layers are applied by simultaneous multilayer coating, and most preferred that all layers are applied by simultaneous multilayer coating.

If a fabric is coated by aqueous coating and have a heat insulation layer and an interlayer additionally, at least one layer of them is preferably formed on the aqueous-based support, and a curl-adjusting layer, a writing layer and a charge-adjusting layer may be formed on the face opposite to the face carrying the receptor layer formed.

In the present invention, the contact angle between the receptor layer surface and water 2 seconds after placement of water droplet, as determined by the static droplet method specified in JIS R-3257, is 68° or less, or the contact angle 60 seconds after placement of water droplet is 28° or less. The contact angle 2 seconds after static placement of water droplet is preferably 68° to 5°, more preferably 68° to 28°, further preferably 64° to 40°. The contact angle 60 seconds after static placement of water droplet is 28° to 4°, more preferably 22° to 4°, further preferably 17° to 5°. It is thus possible to obtain the advantageous effects of the present invention more effectively in combination with other configurations of the present invention. If there is water present at the interface between the heat-sensitive transfer sheet and the heat-sensitive transfer image-receiving sheet during printing under high-humidity environment, it leads to browning in the high density region of near-black image and deterioration in glossiness. The water is present as water droplet, which was found to be generated as a result of surface roughening of the heat-sensitive transfer image-receiving sheet during printing. When the contact angle between the surface of the heat-sensitive transfer image-receiving sheet and water droplet is in the range of the present invention, it is possible to reduce the adverse influence by the water droplet and to solve the problems, such as browning in the high-density region of near-black image and deterioration in glossiness.

In particular in adjusting the contact angle, it is effective to use a latex polymer in the receptor layer and modify the kind and amount of the latex polymer properly. It is also possible to adjust it by modification of the kind and amount of the compound represented by the Formula (I) contained in the receptor layer and also of the kind and amount of the inorganic salt used.

First, the latex polymer used in the receptor layer will be described in detail.

<Latex Polymer>

At least one latex polymer is contained in a receptor layer that is coated in the heat-sensitive transfer image-receiving sheet of the present invention.

The latex polymer for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. The dispersed particles preferably have a mean average particle size (diameter) of about 1 to 50,000 nm, more preferably about 5 to 1,000 nm.

The glass transition temperature (Tg) of the latex polymer that can be used in the present invention is preferably −30° C. to 100° C., more preferably 0° C. to 80° C., further preferably 10° C. to 70° C., and further more preferably 15° C. to 60° C.

The glass transition temperature (Tg), if not practically measurable, may be calculated according to the following Formula.

$$1/Tg=\Sigma(Xi/Tgi)$$

wherein, assuming that the polymer is a copolymer composed of n monomers from i=1 to i=n, Xi is a mass fraction of the i-th monomer (ΣXi=1) and Tgi is a glass transition temperature (measured in absolute temperature) of a homopolymer formed from the i-th monomer. The symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

As the latex polymer used in the heat-sensitive transfer image-receiving sheet of the present invention, latex polymers such as acrylic-series polymers; polyesters; rubbers (e.g., SBR resins); polyurethanes; polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins; are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer used in the present invention is preferably exemplified by any one of vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride copolymer include those described above. Among these, VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex) are preferable.

The polyester-based latex is exemplified by Vylonal MD1200, Vylonal MD1220, Vylonal MD1245, Vylonal MD1250, Vylonal MD1500, Vylonal MD1930, Vylonal MD1985 (trade names, manufactured by Toyobo Co., Ltd.).

A preferable addition amount of the latex polymer is in the range of from 50% by mass to 98% by mass, more preferably from 70% by mass to 95% by mass, in terms of solid content of the latex polymer to the total polymer in the receptor layer.

At least one receptor layer in the present invention preferably contains a compound represented by the following Formula (I).

Next, the compound represented by formula (I) is explained in detail below.

$$R—(OCH_2CH_2)_n—OH \qquad \text{Formula (I)}$$

wherein, R represents an alkyl or alkenyl group having 4 to 30 carbon atoms, and n is an integer of 10 to 30.

The alkyl group or alkenyl group having 4 to 30 carbon atoms of R may be straight-chained or branched. Examples of the alkyl group include n-butyl, s-butyl, t-butyl, n-pentyl, n-hexyl, n-octyl, t-octyl, n-decyl, n-dodecyl, n-tridecyl, n-tetradecyl, n-pentadecyl, n-hexadecyl, n-octadecyl, and n-eicosyl. Examples of the alkenyl group include 2-butenyl, 2-hexenyl, oleyl, geranyoyl, phytolyl and the like. Among the groups above, alkyl groups are preferable.

The number of carbon atoms of each group R is preferably 16 to 22; and m is preferably 14 to 30, more preferably 18 to 26.

Specific examples of the compound represented by formula (I) are set forth below. However, the compound used in the present invention should not be construed as being limited to these specific examples. Hereinafter, $OC_2H_4$ means $OCH_2CH_2$.

(I-1) $C_4H_9—(OC_2H_4)_{10}—OH$
(I-2) $C_4H_9—(OC_2H_4)_{15}—OH$
(I-3) $C_4H_9—(OC_2H_4)_{20}—OH$
(I-4) $C_4H_9—(OC_2H_4)_{25}—OH$
(I-5) $C_4H_9—(OC_2H_4)_{30}—OH$
(I-6) $C_6H_{13}—(OC_2H_4)_{10}—OH$
(I-7) $C_6H_{13}—(OC_2H_4)_{15}—OH$
(I-8) $C_6H_{13}—(OC_2H_4)_{20}—OH$
(I-9) $C_6H_{13}—(OC_2H_4)_{25}—OH$
(I-10) $C_6H_{13}—(OC_2H_4)_{30}—OH$
(I-11) $C_8H_{17}—(OC_2H_4)_{10}—OH$
(I-12) $C_8H_{17}—(OC_2H_4)_{15}—OH$
(I-13) $C_8H_{17}—(OC_2H_4)_{20}—OH$
(I-14) $C_8H_{17}—(OC_2H_4)_{25}—OH$
(I-15) $C_8H_{17}—(OC_2H_4)_{30}—OH$
(I-16) $C_{10}H_{21}—(OC_2H_4)_{10}—OH$
(I-17) $C_{10}H_{21}—(OC_2H_4)_{15}—OH$
(I-18) $C_{10}H_{21}—(OC_2H_4)_{20}—OH$
(I-19) $C_{10}H_{21}—(OC_2H_4)_{25}—OH$
(I-20) $C_{10}H_{21}—(OC_2H_4)_{30}—OH$
(I-21) $C_{12}H_{25}—(OC_2H_4)_{10}—OH$
(I-22) $C_{12}H_{25}—(OC_2H_4)_{15}—OH$
(I-23) $C_{12}H_{25}—(OC_2H_4)_{20}—OH$
(I-24) $C_{12}H_{25}—(OC_2H_4)_{25}—OH$
(I-25) $C_{12}H_{25}—(OC_2H_4)_{30}—OH$
(I-26) $C_{14}H_{21}—(OC_2H_4)_{10}—OH$
(I-27) $C_{14}H_{21}—(OC_2H_4)_{15}—OH$
(I-28) $C_{14}H_{21}—(OC_2H_4)_{20}—OH$
(I-29) $C_{14}H_{21}—(OC_2H_4)_{25}—OH$
(I-30) $C_{14}H_{21}—(OC_2H_4)_{30}—OH$
(I-31) $C_{16}H_{33}—(OC_2H_4)_{10}—OH$
(I-32) $C_{16}H_{33}—(OC_2H_4)_{15}—OH$
(I-33) $C_{16}H_{33}—(OC_2H_4)_{20}—OH$
(I-34) $C_{16}H_{33}—(OC_2H_4)_{25}—OH$
(I-35) $C_{16}H_{33}—(OC_2H_4)_{30}—OH$
(I-36) $C_{18}H_{37}—(OC_2H_4)_{10}—OH$
(I-37) $C_{18}H_{37}—(OC_2H_4)_{15}—OH$
(I-38) $C_{18}H_{37}—(OC_2H_4)_{20}—OH$
(I-39) $C_{18}H_{37}—(OC_2H_4)_{25}—OH$
(I-40) $C_{18}H_{37}—(OC_2H_4)_{30}—OH$
(I-41) $C_{20}H_{41}—(OC_2H_4)_{10}—OH$
(I-42) $C_{20}H_{41}—(OC_2H_4)_{15}—OH$
(I-43) $C_{20}H_{41}—(OC_2H_4)_{20}—OH$
(I-44) $C_{20}H_{41}—(OC_2H_4)_{25}—OH$
(I-45) $C_{20}H_{41}—(OC_2H_4)_{30}—OH$
(I-46) $C_{22}H_{45}—(OC_2H_4)_{10}—OH$
(I-47) $C_{22}H_{45}—(OC_2H_4)_{15}—OH$
(I-48) $C_{22}H_{45}—(OC_2H_4)_{20}—OH$
(I-49) $C_{22}H_{45}—(OC_2H_4)_{25}—OH$
(I-50) $C_{22}H_{45}—(OC_2H_4)_{30}—OH$
(I-51) $C_{30}H_{61}—(OC_2H_4)_{10}—OH$
(I-52) $C_{30}H_{61}—(OC_2H_4)_{15}—OH$
(I-53) $C_{30}H_{61}—(OC_2H_4)_{20}—OH$
(I-54) $C_{30}H_{61}—(OC_2H_4)_{22}—OH$
(I-55) $C_{30}H_{61}—(OC_2H_4)_{25}—OH$
(I-56) $C_{30}H_{61}—(OC_2H_4)_{30}—OH$
(I-57) $C_{18}H_{35}—(OC_2H_4)_{10}—OH$
(I-58) $C_{18}H_{35}—(OC_2H_4)_{15}—OH$
(I-59) $C_{18}H_{35}—(OC_2H_4)_{20}—OH$
(I-60) $C_{18}H_{35}—(OC_2H_4)_{25}—OH$
(I-61) $C_{18}H_{35}—(OC_2H_4)_{30}—OH$

Favorable compounds among those above are compounds (I-17) to (I-20), (I-22) to (I-25), (I-27) to (I-30), (I-32) to (I-35), (I-37) to (I-40), (I-42) to (I-45), (I-47) to (I-50), and (I-52) to (I-56); and particularly preferable are compounds (I-33), (I-34), (I-38), (I-39), (I-43) to (I-44), (I-48), and (I-49).

Many of the compounds represented by the Formula (I) used in the present invention are commercially available, for example, from NOF Corporation Co., Ltd., Kao Corporation, Lion Co., Ltd., Sanyo Chemical Industries Co., Ltd., Nihon-Emulsion Co., Ltd. and others, and these compounds may also be produced by known methods. Typical commercial products thereof include Nonion K-220, Nonion K-230, Nonion P-210, Nonion P-213, Nonion E-212, Nonion E-215, Nonion E-230, Nonion S-215, Nonion S-220 (all, manufactured by NOF Corporation), EMALEX620, (trade name: manufactured by Nihon-Emulsion Co., Ltd.).

The compounds represented by Formula (I) may be used alone or in combination of any two or more compounds. The compound may be added as it is or may be added to the receptor layer-coating solution as a solution as it is dissolved in water or an organic solvent such as methanol, ethanol, isopropyl alcohol, acetone, ethylene or ethylene glycol, or alternatively, may be added to a latex polymer dispersion. Yet alternatively, it may be added to the receptor layer-coating solution, as it is dissolved in a high-boiling solvent, a low-boiling solvent, or the mixed solvent thereof and emulsified and dispersed in the presence of a surfactant.

The addition amount of the compound represented by Formula (I) is preferably 0.03 to 0.3 $g/m^2$, more preferably 0.01 to 0.3 $g/m^2$.

The present invention preferably contains an inorganic salt in the receptor layer.

Examples of the inorganic salts include halides, sulfate compounds, nitrate compounds, phosphate compounds and thiocyanate compounds of alkali metals, alkali-earth metals and ammonium, and the like. Particularly favorable are halides, sulfate compounds and nitrate compounds of alkali metals. Typical examples of these inorganic salts include sodium chloride, sodium bromide, potassium bromide, potassium chloride, calcium chloride, potassium nitrate, potassium sulfate, ammonium chloride, sodium phosphate, potassium phosphate, sodium nitrate, potassium thiocyanate, sodium sulfate, ammonium bromide, sodium sulfate, magnesium sulfate, ammonium sulfate, potassium carbonate, lithium chloride, lithium bromide, and the like.

The amount of the inorganic salt used is preferably 0.01 g to 0.9 g, more preferably 0.02 g to 0.9 g, and most preferably 0.05 g to 0.3 g per 1 $m^2$. It is also possible to adjust the contact angle by modification of the addition amount.

<Water-Soluble Polymer>

In the heat-sensitive transfer image-receiving sheet of the present invention, it is one of preferred embodiments of the present invention that the receptor layer contains a water-soluble polymer.

Herein, the "water-soluble polymer" means a polymer which dissolves, in 100 g of water at 20° C., in an amount of preferably 0.05 g or more, more preferably 0.1 g or more, further preferably 0.5 g or more, and particularly preferably 1 g or more. As the water-soluble polymers, natural polymers, semi-synthetic polymers and synthetic polymers are preferably used.

Among the water-soluble polymer that can be used in the heat-sensitive transfer image-receiving sheet of the present invention, the natural polymers and the semi-synthetic polymers will be explained in detail. Specific examples include the following polymers: plant type polysaccharides such as κ-carrageenans, ι-carrageenans, λ-carrageenans, and pectins; microbial type polysaccharides such as xanthan gums and dextrins; animal type natural polymers such as gelatins and caseins; and cellulose-based polymers such as carboxymethylcelluloses, hydroxyethylcelluloses, and hydroxypropylcelluloses.

Of the natural polymers and the semi-synthetic polymers that can be used in the present invention, gelatin is preferred. Gelatin having a molecular mass of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

Of the water-soluble polymers that can be used in the heat-sensitive transfer image-receiving sheet of the present invention, examples of the synthetic polymers include polyvinyl pyrrolidone, polyvinyl pyrrolidone copolymers, polyvinyl alcohol, polyethylene glycol, polypropylene glycol, and water-soluble polyesters.

Among the synthetic polymers that can be used in the present invention, polyvinyl alcohols are preferable.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H (trade names, manufactured by KURARAY Co., Ltd.); partially saponificated polyvinyl alcohol such as PVA-203, PVA-205, PVA-210 and PVA-220 (trade names, manufactured by KURARAY Co., Ltd.); and modified polyvinyl alcohols such as C-118, HL-12E, KL-118 and MP-203 (trade names, manufactured by KURARAY Co., Ltd.).

In the present invention, water-soluble polymer is preferably used from 0.01 g/$m^2$ to 0.3 g/$m^2$.

Further, the receptor layer may contain ultraviolet absorbents, release agents, sliding agents, antioxidants, antiseptics, and surfactants.

(Ultraviolet Absorbent)

The heat-sensitive transfer image-receiving sheet of the present invention may contain any ultraviolet absorbents. As the ultraviolet absorbents, use can be made of conventionally known inorganic or organic ultraviolet absorbents. As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting. In addition, disclosed is a method of obtaining ultraviolet-shielding resins by the steps of dissolving ultraviolet absorbents in a monomer or oligomer of the resin to be used, and then polymerizing the monomer or oligomer (JP-A-2006-21333). In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitation.

Examples of commercially available ultraviolet absorbents include TINUVIN-P (trade name, manufactured by Ciba-Geigy), JF-77 (trade name, manufactured by JOHOKU CHEMICAL Co., Ltd.), SEESORB 701 (trade name, manufactured by SHIRAISHI CALCIUM KAISHA, Ltd.), SUMISORB 200 (trade name, manufactured by Sumitomo Chemical Co., Ltd.), VIOSORB 520 (trade name, manufactured by KYODO CHEMICAL Co., Ltd.), and ADKSTAB LA-32 (trade name, manufactured by ADEKA).

<Heat Insulation Layer>

The heat insulation layer that is coated in the heat-sensitive transfer image-receiving sheet of the present invention may be a single layer or double or more multiple layers.

The heat insulation layer preferably contains hollow polymer particles.

The hollow polymer particles in the present invention are polymer particles having voids inside of the particles. The hollow polymer particles are preferably aqueous dispersion. Examples of the hollow polymer particles include (1) non-foaming type hollow particles obtained in the following manner: a dispersion medium such as water is contained inside of a capsule wall formed of a polystyrene, acrylic resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names).

Of these, non-foaming hollow polymer particles of the foregoing (1) are preferred. If necessary, use can be made of a mixture of two or more kinds of polymer particles.

The average particle diameter (particle size) of the hollow polymer particles is preferably 0.1 to 5.0 μm, more preferably 0.2 to 3.0 μm, and particularly preferably 0.3 to 1.0 μm.

The hollow ratio (percentage of void) of the hollow polymer particles is preferably in the range of from about 20% to about 70%, and particularly preferably from 20% to 50%.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof.

The hollow ratio of the hollow polymer particles is calculated by the ratio of the volume of voids to the volume of a particle.

The glass transition temperature (Tg) of the hollow polymer particles is preferably 70 to 200° C., more preferably 90 to 180° C.

The hollow polymer particles are preferably hollow latex polymer particles.

It is preferred that the heat insulation layer contains a water-soluble polymer as a binder in addition to hollow polymer particles. A preferable water-soluble polymer is exemplified by water-soluble polymers described in the section of Receptor layer. Among these water-soluble polymers, gelatin and a polyvinyl alcohol are more preferable. These resins may be used either singly or as a mixture thereof.

A thickness of the heat insulation layer containing the hollow polymer particles is preferably from 5 to 50 μm, more preferably from 5 to 40 μm.

(Interlayer)

In the present invention, there is an interlayer formed between the heat insulation layer and the support.

A function of the interlayer is exemplified by white background adjustment, antistatic, imparting of adhesion and imparting of smoothness (leveling). The function of the interlayer is not limited to these, and a previously known interlayer may be provided.

The interlayer preferably contains a water-soluble polymer and a latex polymer, and the water-soluble polymer is, for example, the water-soluble polymer described for the receptor layer. Particularly in the present invention, it is preferably a water-soluble polymer other than gelatin; cellulosic and synthetic polymers are preferable; examples thereof include those described above; and the favorable water-soluble polymers are also those described for the receptor layer excluding gelatin. It is particularly preferably a polyvinyl alcohol compound.

<Release Agent>

To the heat-sensitive transfer image-receiving sheet of the present invention, a release agent may be added to secure a releasing property between the heat-sensitive transfer sheet and the heat-sensitive transfer image-receiving sheet at the time of image printing.

As the release agent, there can be used, for example, solid waxes such as polyethylene wax, paraffin wax, fatty acid ester wax, and amide wax; and silicone oil, phosphoric ester-based compounds, fluorine-based surfactants, silicone-based surfactants, and other release agents known in this technical field. Of these release agents, preferred are fatty acid ester waxes, fluorine-based surfactants, and silicone-based compounds such as silicone-based surfactants, silicone oil and/or hardened products thereof.

<Surfactant>

Further, in the heat-sensitive transfer image-receiving sheet of the present invention, a surfactant may be contained in any of such layers as described above. Of these layers, it is preferable to contain the surfactant in the receptor layer and the intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

<Matting Agent>

To the heat-sensitive transfer image-receiving sheet of the present invention, a matting agent may be added in order to prevent blocking, or to give a release property or a sliding property. The matting agent may be added on the same side as the coating side of the receptor layer, or on the side opposite to the coating side of the receptor layer, or on both sides.

Examples of the matting agent generally include fine particles of water-insoluble organic compounds and fine particles of water-insoluble inorganic compounds. In the present invention, the organic compound-containing fine particles are preferably used from the viewpoints of dispersion properties.

In so far as the organic compound is incorporated in the particles, there may be organic compound particles consisting of the organic compound alone, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

<Antiseptic>

To the heat-sensitive transfer image-receiving sheet of the present invention, antiseptics may be added. The antiseptics that may be used in the image-receiving sheet of the invention are not particularly limited. For example, use can be made of materials described in Bofubokabi (Preservation and Antifungi) HAND BOOK, Gihodo shuppan (1986), Bokin Bokabi no Kagaku (Chemistry of Anti-bacteria and Antifungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

<Hardening Agent (Crosslinking Agent)>

A hardening agent that is used in the present invention as a crosslinking agent may be added to any one of the layers on the support, such as a receptor layer, a heat-insulating layer, and a subbing layer. Herein, the term "crosslinking agent" is also referred to as a compound or crosslinking agent capable of crosslinking a water-soluble polymer. Particularly in the present invention, it is preferable that the subbing layer is hardened by the hardening agent.

Preferable examples of the hardener that can be used in the present invention include H-1, 4, 6, 8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned.

Preferable examples of the hardener include a vinyl sulfone-series hardener and chlorotriazines.

More preferable hardeners in the present invention are compounds represented by following formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer from 1 to 4. When the compound represented by formula (B) or (C) is a high-molecular (polymer) compound, L represents an organic linking group containing a polymer chain, and n denotes an integer in the range of from 10 to 1,000.

In formulae (B) and (C), X is preferably a chlorine atom or a bromine atom, and further preferably a bromine atom. n is an integer from 1 to 4, preferably an integer from 2 to 4, more preferably 2 or 3, and most preferably 2.

L represents an organic group having n-valency, and preferably an aliphatic hydrocarbon group, an aromatic hydrocarbon group or a heterocyclic group, and any of these groups may be combined through an ether bond, ester bond, amide bond, sulfonamide bond, urea bond, urethane bond, or the like. Also, each of these groups may be further substituted. Examples of the substituent include a halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamido group, carbamoyl group, sulfamoyl group, sulfonyl group, phosphoryl group, carboxyl group, or sulfo group. Among these groups, a halogen atom, alkyl group, hydroxy group, alkoxy group, aryloxy group, or acyloxy group is preferable.

Specific examples of the vinylsulfone-series hardener include the following compounds (VS-1) to (VS-27), although the present invention is not limited to those.

(VS-1)

$$CH_2{=}CH{-}SO_2{-}CH_2{-}SO_2{-}CH{=}CH_2$$

(VS-2)

$$CH_2{=}CH{-}SO_2{-}CH_2CH_2{-}SO_2{-}CH{=}CH_2$$

(VS-3)

$$CH_2{=}CH{-}SO_2{-}CH_2CH_2CH_2{-}SO_2{-}CH{=}CH_2$$

(VS-4)

$$CH_2{=}CH{-}SO_2{-}CH_2\overset{\overset{CH_3}{|}}{C}HCH_2{-}SO_2{-}CH{=}CH_2$$

(VS-5)

$$CH_2{=}CH{-}SO_2{-}CH_2OCH_2{-}SO_2{-}CH{=}CH_2$$

(VS-6)

$$CH_2{=}CH{-}SO_2{-}CH_2CH_2OCH_2CH_2{-}SO_2{-}CH{=}CH_2$$

(VS-7)

$$CH_2{=}CH{-}SO_2{-}CH_2\underset{\underset{O}{\|}}{C}NHCH_2CH_2NH\underset{\underset{O}{\|}}{C}CH_2{-}SO_2{-}CH{=}CH_2$$

(VS-8)

$$CH_2{=}CH{-}SO_2{-}CH_2\underset{\underset{O}{\|}}{C}NHCH_2CH_2CH_2NH\underset{\underset{O}{\|}}{C}CH_2{-}SO_2{-}CH{=}CH_2$$

(VS-9)

$$CH_2{=}CH{-}SO_2{-}CH_2\overset{\overset{OH}{|}}{C}HCH_2{-}SO_2{-}CH{=}CH_2$$

(VS-10)

$$CH_2{=}CH{-}SO_2{-}CH_2\overset{\overset{OH}{|}}{C}H\underset{\underset{OH}{|}}{C}HCH_2{-}SO_2{-}CH{=}CH_2$$

(VS-11)

$$CH_2{=}CH{-}SO_2{-}CH_2\overset{\overset{OH}{|}}{C}HCH_2\overset{\overset{OH}{|}}{C}HCH_2{-}SO_2{-}CH{=}CH_2$$

(VS-12)

$$CH_2{=}CH{-}SO_2{-}CH_2\overset{\overset{OH}{|}}{C}HCH_2CH_2\overset{\overset{OH}{|}}{C}HCH_2{-}SO_2{-}CH{=}CH_2$$

-continued (VS-13)

$CH_2{=}CH{-}SO_2{-}CH_2CH(OH)CH_2CH(CH_3)CH_2CH(OH)CH_2{-}SO_2{-}CH{=}CH_2$ (VS-14)

$CH_2{=}CH{-}SO_2{-}CH_2CH(OH)CH_2OCH_2CH(OH)CH_2{-}SO_2{-}CH{=}CH_2$ (VS-15)

$CH_2{=}CH{-}SO_2{-}CH_2CH(OH)CH_2C(=O)CH_2CH(OH)CH_2{-}SO_2{-}CH{=}CH_2$ (VS-16)

$CH_2{=}CH{-}SO_2{-}CH_2CH(OH)CH_2NH(H)CH_2CH(OH)CH_2{-}SO_2{-}CH{=}CH_2$ (VS-17)

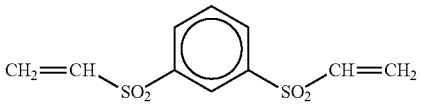

(VS-18)

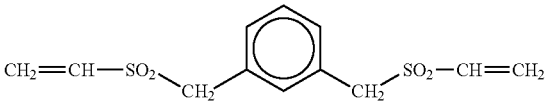

(VS-19)

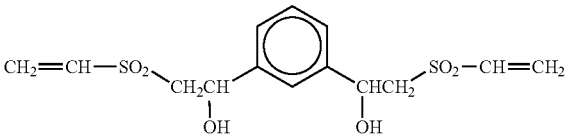

(VS-20)

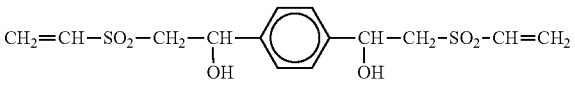

(VS-21)

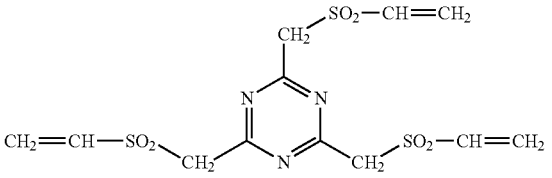

(VS-22)

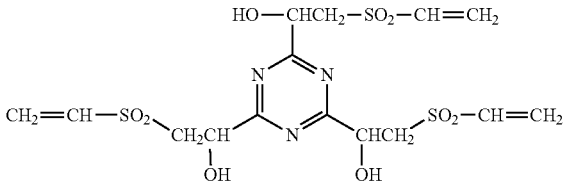

(VS-23)

$Cl{-}CH_2{-}CH_2{-}SO_2{-}CH_2{-}SO_2{-}CH_2{-}CH_2{-}Cl$ (VS-24)

$Br{-}CH_2{-}CH_2{-}SO_2{-}CH_2{-}SO_2{-}CH_2{-}CH_2{-}Br$ (VS-25)

$Br{-}CH_2{-}CH_2{-}SO_2{-}CH_2OCH_2{-}SO_2{-}CH_2{-}CH_2{-}Br$

-continued (VS-26)

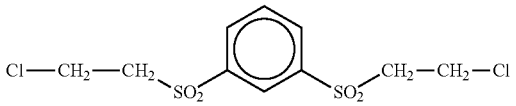

(VS-27)

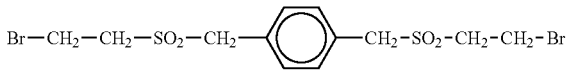

These hardeners may be obtained with reference to the method described in, for example, the specification of U.S. Pat. No. 4,173,481.

Furthermore, as the chlorotriazine-series hardener, a 1,3,5-triazine compound in which at least one of the 2-position, 4-position and 6-position of the triazine ring in the compound is substituted with a chlorine atom, is preferable. A 1,3,5-triazine compound in which two or three of the 2-position, 4-position and 6-position of the triazine ring each are substituted with a chlorine atom, is more preferable. Alternatively, use may be made of a 1,3,5-triazine compound in which at least one of the 2-position, 4-position and 6-position of the triazine ring is substituted with a chlorine atom, and the remainder position(s) is substituted with a group(s) or atom(s) other than a chlorine atom. Examples of these other groups or atom(s) include a hydrogen atom, a bromine atom, a fluorine atom, an iodine atom, an alkyl group, an alkenyl group, an alkynyl group, a cycloalkyl group, a cycloalkenyl group, an aryl group, a heterocyclic group, a hydroxy group, a nitro group, a cyano group, an amino group, a hydroxylamino group, an alkylamino group, an arylamino group, a heterocyclic amino group, an acylamino group, a sulfonamido group, a carbamoyl group, a sulfamoyl group, a sulfo group, a carboxyl group, an alkoxy group, an alkenoxy group, an aryloxy group, a heterocyclic oxy group, an acyl group, an acyloxy group, an alkyl- or aryl-sulfonyl group, an alkyl- or aryl-sulfinyl group, an alkyl- or aryl-sulfonyloxy group, a mercapto group, an alkylthio group, an alkenylthio group, an arylthio group, a heterocyclic thio group, and an alkyloxy- or aryloxy-carbonyl group.

Specific examples of the chlorotriazine-series hardener include 4,6-dichloro-2-hydroxy-1,3,5-triazine or its sodium salt, 2-chloro-4,6-diphenoxytriazine, 2-chloro-4,6-bis[2,4,6-trimethylphenoxy]triazine, 2-chloro-4,6-diglycidoxy-1,3,5-triazine, 2-chloro-4-(n-butoxy)-6-glycidoxy-1,3,5-triazine, 2-chloro-4-(2,4,6-rimethylphenoxy)-6-glycidoxy-1,3,5-triazine, 2-chloro-4-(2-chloroethoxy)-6-(2,4,6-trimethylphenoxy)-1,3,5-triazine, 2-chloro-4-(2-bromoethoxy)-6-(2,4,6-trimethylphenoxy)-1,3,5-triazine, 2-chloro-4-(2-di-n-butylphosphatoethoxy)-6-(2,4,6-trimethylphenoxy)-1,3,5-triazine, and 2-chloro-4-(2-di-n-butylphosphatoethoxy)-6-(2,6-xylenoxy)-1,3,5-triazine, but the invention is not limited to those.

Such a compound can be easily produced by reacting cyanuric chloride (namely, 2,4,6-trichlorotriazine) with, for example, a hydroxy compound, thio compound or amino compound corresponding to the target substituent on the hetero ring.

These hardeners are used in an amount of generally 0.001 to 1 part by mass, preferably 0.005 to 0.5 part by mass, per part by mass of the water-soluble polymer. In particular, if used in the interlayer, it is preferably used in an amount of 0.01 to 0.9 $g/m^2$.

<Support>

As the support that is used for the heat-sensitive transfer image-receiving sheet of the present invention, there may be used previously known supports with a preferable example being a water-proof support. The use of the waterproof support makes it possible to prevent the support from absorbing moisture, whereby a fluctuation in the performance of the receptor layer with the lapse of time can be prevented. As the waterproof support, for example, coated paper, laminate paper or synthetic paper may be used. Among them, laminate paper is preferable.

<Curl Adjusting Layer>

In the heat-sensitive transfer image-receiving sheet of the present invention, if necessary, a curl adjusting layer is preferably formed. For the curl adjusting layer, for example, a polyethylene laminate and a polypropylene laminate may be used. Specifically, the curl adjusting layer may be formed in the same manner as described in, for example, JP-A-61-110135 and JP-A-6-202295.

<Writing Layer and Charge Controlling Layer>

In the heat-sensitive transfer image-receiving of the present invention, if necessary, a writing layer or a charge controlling layer may be disposed. For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3,585,585.

<Method of Producing Heat-Sensitive Transfer Image-Receiving Sheet>

These heat-sensitive transfer image-receiving sheets are produced by the steps of preparing coating liquids, applying the coating liquids to the support and drying them. In the present invention, at least one receptor layer is coated. The image-receiving sheets in which the number of constituent layers of either or both of their individual receptor layer and heat-insulation layer is two or more are also preferred embodiments of the present invention. In the present invention, at least the heat-insulation layer and a constituent layer adjacent thereto on the receptor layer side are preferably formed by simultaneous multilayer coating. The constituent layer on the receptor layer side may be either a receptor layer or an inter layer having another function as stated above.

Each of steps in the production process is described below in detail.

(Preparation of Coating Liquids)

For preparing coating liquids finally having liquid properties responsive to desired quality by measuring and mixing ingredients, known methods and apparatus can be utilized. Examples of a measurement method usable herein include a method of measuring weight and a method of measuring volume. Examples of an agitator usable for mixing include a propeller stirrer and a jet agitator.

On the occasion of adding gelatin, it is also possible to adopt a method in which gelatin powder is dispersed and impregnated in room-temperature water, the resulting swollen gelatin is made to dissolve with the rise of temperature, and then added to the coating liquids.

In order to measure physical properties of the coating liquid, there can be used various measuring apparatuses such as a viscometer, a surface tension measuring instrument, a hydrometer and a pH meter. A method of measuring viscosity of the coating liquid is classified into two methods: a method of measuring a resistance force that is imposed on a rotor in a liquid, and a method of measuring a pressure loss at the time when a liquid is passed through an orifice or a capillary. The former measuring apparatus is a rotary viscometer that is represented by a B-type viscometer. The latter is a capillary viscometer that is represented by Ostwald's viscometer. In the present invention, the former apparatus, namely, the rotary viscometer is used. The measurement was conducted at 40° C.

(Coating)

Coating of each layer can be preferably performed using a method chosen appropriately from the methods allowing simultaneous multilayer coating among known methods including roll coating, bar coating, gravure coating, gravure reverse coating, die coating, slide coating and curtain coating methods. Of these known methods, the curtain coating and slide coating methods are methods in which the thickness of coating film is determined by the flow rate of liquid dispensed by a pump or the like, and allow simultaneous multilayer coating.

It is known that in the case of producing a heat-sensitive transfer image-receiving sheet composed of plural layers having different functions from each other (for example, an air cell layer, a heat insulation layer, an intermediate layer, and a receptor layer) on a support, it may be produced by applying each layer successively one by one, or by overlapping the layers each already coated on the support, as shown in, for example, JP-A-2004-106283, JP-A-2004-181888 and JP-A-2004-345267. It has been known in photographic industries, on the other hand, that productivity can be greatly improved, for example, by providing plural layers through simultaneous multilayer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent application); and Edgar B. Gutoff, et al. and "Coating and Drying Defects: Troubleshooting Operating Problems", John Wiley & Sons, 1995, pp. 101-103. According to these coating methods, two or more kinds of coating liquids are fed simultaneously into a coater and formed into two or more different layers. These methods can be preferably applied to the present invention because they can deliver coating uniform in thickness and allow simultaneous multilayer coating.

As an example of apparatus for the slide coating method, there is a multilayer slide bead coater proposed by Russell et al. in U.S. Pat. No. 2,761,791. Examples of the shape of the coater are also described in Stephen F. Kistler & Petert M. Schweizer, "Liquid Film Coating", Chapman & Hall (1997).

The slide bead coater is mainly composed of a coating head and a backup roller which supports a support continuously moving as it is winding about the backup roll. In the inside of a coating head-forming block are provided liquid pools which diffusively flow their individual coating liquids dispensed from liquid feed lines to the width direction of the support, and narrow slits connected with these liquid pools are formed in an open state so as to reach a slide surface. This slide surface is formed on the top side of the coating head, and inclined downward the backup roller side.

The coating liquids fed into their respective liquid pools are pressed out of their individual slits onto the slide surface, successively superposed upon one another as they are running down on the slide surface, thereby forming a multilayer coating, and reach to the tip of the lower end of the slide surface, on the whole, without mixing much with one another. The coating liquids arriving at the tip form their beads in the gap between the tip and the surface of the support moving continuously as it is winding about the backup roll, and applied to the support via these coating liquid beads. For the purpose of stabilizing the beads, the pressure imposed on the lower part is reduced. Therefore, a decompression chamber is formed at the lower place of the backup roller. This decompression chamber forms a negative pressure on the lower side of the beads, and the negative pressure functions so as to not only stabilize the beads but also allow easy running-down of excess coating liquids, which remain without applied to web, into the decompression chamber.

The curtain coating is a method of coating a freely falling liquid film on a support continuously running underneath the liquid film at a constant speed. This method has some coating systems including an extrusion system and a slide system. In the slide coater, a multilayer liquid film formed on a slide surface falls freely from the slide end. Therefore, the shape of the terminal of the slide surface is devised so as to smoothly form the falling liquid film.

In the simultaneous multilayer coating, it is required that the viscosity and surface tension of a coating liquid to form each layer be adjusted so that formation of homogeneous coating film and satisfactory coating properties are achieved. The viscosity of each coating liquid can be easily adjusted by using known thickeners or viscosity-depressants. And the surface tension of each coating liquid can be adjusted by addition of various surfactants.

In the present invention, the viscosity of the receptor layer can be adjusted by a solid content and/or using a thickener. The viscosity of each receptor layer at 40° C. is preferably in the range of from 3 mPa·s to 300 mPa·s, more preferably from 3 mPa·s to 100 mPa·s, and most preferably from 3 mPa·s to 30 mPa·s.

In feeding into a coating section each coating liquid prepared so as to have appropriate values of physical properties including concentration, viscosity, surface tension and pH, it is required that the coating liquid is continuously fed as foams and extraneous materials are eliminated.

Although various methods allow continuous feeding of each coating liquid at a constant flow rate, it is preferable to use a metering pump in terms of accuracy and reliability. Examples of the metering pump include a plunger pump and a diaphragm type pump. In the diaphragm type pump, a plunger and a liquid to be fed are placed in isolation by means of two diaphragms, and the motion of the plunger is transmitted by way of a driving oil and pure water between the two diaphragms to the liquid to be fed. Fluctuation in the flow rate of a liquid-feeding pump is linked with fluctuation in the coating film thickness, so sufficient accuracy is required for the flow rate.

When it is required to reduce influences of pulsation of a pump, an auxiliary device for absorbing pulsation is used. Some systems for the auxiliary device are known, and one example thereof is a pulsation-absorbing device of pipeline type (JP-A-1-255793).

For elimination of extraneous materials, it is preferable to filter coating liquids. Various materials can be used as filtering media, and one example thereof is a cartridge filter. Prior to being used, filtering media preferably undergo treatment for prevention of mixing of air held in pores of the filtering media into coating liquids in the form of air bubbles. To such preventive treatment, several known methods are applicable. As an example thereof, mention may be made of pretreatment with a liquid containing a surfactant (U.S. Pat. No. 5,096,602).

Similarly to extraneous materials, air bubbles also become a cause of defects in coated surface conditions. Therefore, it is preferable that air bubbles mixed into coating liquids and foams floating on the solution surface are eliminated by defoaming and antifoaming treatment. As techniques for such treatment, there are separation of air bubbles from solutions and dissolution of air bubbles into solutions. Examples of a known technique for the separation include reduced-pressure defoaming, ultrasonic defoaming and centrifugal defoaming. And an example of a known technique for dissolution into solutions is ultrasonic pipeline defoaming.

In the case of using additives which degrade stability with lapse of time of a coating liquid to which they are added, it is known to adopt a system that the additives are added right before the coating liquid is fed into a coating section, during the liquid-feeding process, for the purpose of reducing a time lapsed from the addition to the coating. This system can be utilized in the present invention too. Examples of a mixer usable therein include a static mixer and a dynamic mixer.

(Drying)

After coating, a coated product having a coating film formed on a support is dried in a drying zone, made to pass through a humidity conditioning zone, and then wound into a roll. In the present invention, it is preferable that a multilayer coating film on a support is solidified immediately after the formation thereof. When the coating film is exposed to a strong drying wind while it is still in an insufficiently-solidified state, wave motion is caused and unevenness shows up. In addition, when an organic solvent is contained in the outermost layer of the coating film, the wind causes nonuniform evaporation of the organic solvent on the slide surface and immediately after coating to result in occurrence of unevenness. From this point of view, it is advantageous to adopt aqueous coating liquids.

In another case where a binder capable of gelling at low temperatures, such as gelatin, is contained in coating liquids, it is preferable that the coating film is subjected to cooling solidification through quick decrease in temperature immediately after multiple layers are formed on a support (set process), and then drying is performed under raised temperatures. By doing so, more uniform and more homogenous coating film can be formed.

The term "set process" as used herein means a gelling promotion process in which the viscosity of a coating film composition is increased by decreasing the temperature, e.g., through exposure of the coating film to a cold wind; as a result, inter-layer mobility and intra-layer mobility of ingredients are declined.

In the present invention, a temperature condition of the set process in which the cold wind is used is preferably less than 25° C. in dry-bulb temperature, more preferably 15° C. or less in dry-bulb temperature. The coating film is preferably exposed to the cold wind within 5 seconds directly after coating. A period of time when the coating film is exposed to the cold wind depends on a coating transport speed, but preferably not less than 3 seconds, more preferably from 3 seconds to 120 seconds, and furthermore preferably from 15 seconds to 100 seconds.

In the present invention, the viscosity of each receptor layer at 40° C. is preferably in the range of from 3 mPa·s to 300 mPa·s, more preferably from 3 mPa·s to 100 mPa·s, and most preferably from 3 mPa·s to 30 mPa·s, as described above. It is preferred that the receptor layer contains neither raw materials nor chemicals capable of enhancing a set property at the set process. Specifically, it is preferred to add none of various kinds of known gelling agents to a subbing layer-coating liquid. The gelling agents are exemplified by gelatin, pectin, agar, carrageenan, and Jerangam.

Since latex is a main constituent of coating liquids in the present invention, the coating film causes uneven shrinkage when they are quickly dried, and thereby cracks tend to develop in the dried coating film. Therefore, slow drying is preferred in the present invention. In order to satisfy such a requirement, it is required that the drying temperature and the volume and dew point of drying wind are adjusted appropriately and drying is performed while controlling the drying speed.

Typical drying devices include an air-loop system and a helical system. The air-loop system is a system in which drying blasts are made to blow on a coated product supported by rollers, and wherein a duct may be mounted either longitudinally or transversely. Such a system has a high degree of freedom in setting of the volume of drying wind, because a drying function and a transporting function are basically separated therein. However, many rollers are used therein, so base-transporting failures, such as gathering, wrinkling and slipping, tend to occur. The helical system is a system in which a coated product is wound round a cylindrical duct in a helical fashion, and transported and dried as it is floated by drying wind (air floating). So no support by rollers is basically required (JP-B-43-20438). In the present invention, these drying devices can be preferably used.

The present invention can provide an image-receiving sheet for thermal transfer recording that is resistant to deterioration in glossiness and density, browning in the high-density region of near-black image and generation of irregular color during printing under high-humidity environment.

The present invention will be described in more detail based on the following examples, but the invention is not intended to be limited thereto. In the following Examples, the terms "part" and "%" are values by mass, unless they are indicated differently in particular.

EXAMPLES

Production of Heat-Sensitive Transfer Sheets

A polyester film 6.0 μm in thickness (trade name: Diafoil K200E-6F, manufactured by MITSUBISHI POLYESTER FILM CORPORATION), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer painted surface of the thus-formed polyester film, individual heat-sensitive transfer layers in yellow, magenta and cyan, and a transferable protective layer laminate in area order by painting. In this way, a heat-sensitive transfer sheet was produced. The solid coating amount in each of the heat-sensitive transfer layers (dye layers) was set to 0.8 g/m$^2$.

In the formation of the transferable protective layer laminate, a releasing-liquid-coating liquid was painted, a protective-layer-coating liquid was painted thereon, the resultant was dried, and then an adhesive-layer-coating liquid was painted thereon.

| | |
|---|---|
| Back side layer-coating liquid | |
| Acrylic polyol resin (trade name: ACRYDIC A-801, manufactured by Dainippon Ink and Chemicals, Incorporated) | 18.0 mass parts |
| Zinc stearate (trade name: SZ-2000, manufactured by Sakai Chemical Industry Co., Ltd.) | 0.70 mass part |
| Phosphate ester (trade name: PLYSURF A217, manufactured by Dai-ichi Kogyo Seiyaku Co., Ltd.) | 1.82 mass parts |
| Isocyanate (50% solution) (trade name: BURNOCK D-800, manufactured by Dainippon Ink and Chemicals, Incorporated) | 5.6 mass parts |
| Methyl ethyl ketone/Toluene (1/1, at mass ratio) | 75 mass parts |
| Yellow-dye-layer-coating liquid | |
| Dye compound (Y-1) | 4.2 mass parts |
| Dye compound (Y-2) | 3.6 mass parts |
| Polyvinylacetal resin (trade name: ESLEC KS-1, manufactured by Sekisui Chemical Co., Ltd.) | 6.1 mass parts |
| Polyvinylbutyral resin (trade name: DENKA BUTYRAL #6000-C, manufactured by DENKI KAGAKU KOGYOU K. K.) | 2.1 mass parts |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

Y-1

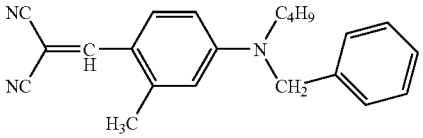

Y-2

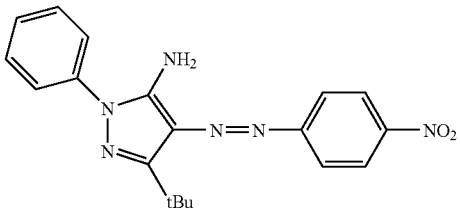

| | |
|---|---|
| Magenta-dye-layer-coating liquid | |
| Dye compound (M- 1) | 1.8 mass parts |
| Dye compound (M-2) | 7.6 mass parts |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |

| | |
|---|---|
| Methyl ethyl ketone/Toluene (2/1, at mass ratio) | 84 mass parts |

M-1

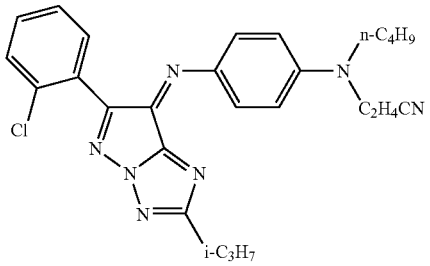

M-2

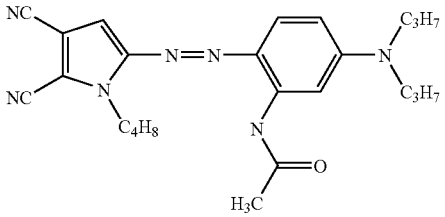

| | |
|---|---|
| Cyan-dye-layer-coating liquid | |
| Dye compound (C-1) | 2.4 mass part |
| Dye compound (C-2) | 5.3 mass parts |
| Polyvinylacetal resin | 7.4 mass parts |
| (trade name: ESLEC KS-1, manufactured by Sekisui Chemical Co., Ltd.) | |
| Polyvinylbutyral resin | 0.8 mass part |
| (trade name: DENKA BUTYRAL #6000-C, manufactured by DENKI KAGAKU KOGYOU K. K.) | |
| Release agent | 0.05 mass part |
| (trade name: X-22-3000T, manufactured by Shin-Etsu Chemical Co., Ltd.) | |
| Release agent | 0.03 mass part |
| (trade name: TSF4701, manufactured by MOMENTIVE Performance Materials Japan LLC.) | |
| Matting agent | 0.15 mass part |
| (trade name: Flo-thene UF, manufactured by Sumitomo Seika Chemicals Co., Ltd.) | |
| Methyl ethyl ketone/Toluene (2/1, at mass ratio) | 84 mass parts |

C-1

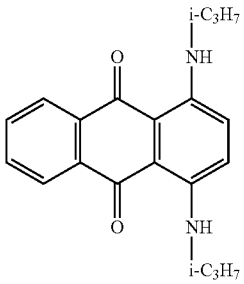

C-2

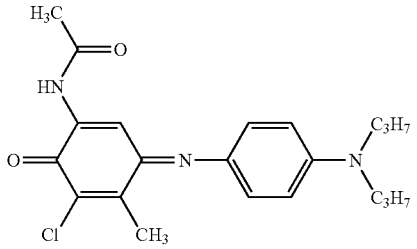

Transfer Protective Layer Laminate

On the polyester film coated with the dye layers as described above, coating solutions of a releasing layer, a protective layer and an adhesive layer each having the following composition was coated, to form a transfer protective layer laminate. Coating amounts of the releasing layer, the protective layer and the adhesive layer after drying were 0.2 g/m$^2$, 0.5 g/m$^2$ and 2.0 g/m$^2$, respectively.

| | |
|---|---|
| Releasing-layer-coating liquid | |
| Modified cellulose resin (trade name: L-30, manufactured by DAICEL CHEMICAL TNDUSTRIES, LTD.) | 7.5 mass parts |
| Methyl ethyl ketone | 92.5 mass parts |
| Protective-layer-coating liquid | |
| Acrylic resin solution (solid content 40%) (trade name: UNO-1, manufactured by Gifu Ceramics Limited) | 85 mass parts |
| Methanol/isopropanol (1/1, at mass ratio) | 15 mass parts |
| Adhesive-layer-coating liquid | |
| Acrylic resin (trade name: DIANAL BR-77, manufactured by MITSUBISHI RAYON Co., Ltd.) | 25 mass parts |
| The following ultraviolet absorber UV-1 | 1 mass parts |
| The following ultraviolet absorber UV-2 | 2 mass parts |
| The following ultraviolet absorber UV-3 | 1 mass parts |
| The following ultraviolet absorber UV-4 | 2 mass part |
| PMMA fine particles (polymethyl methacrylate fine particles) | 0.4 mass part |
| Methyl ethyl ketone/toluene (2/1, at mass ratio) | 70 mass parts |

(UV-1)

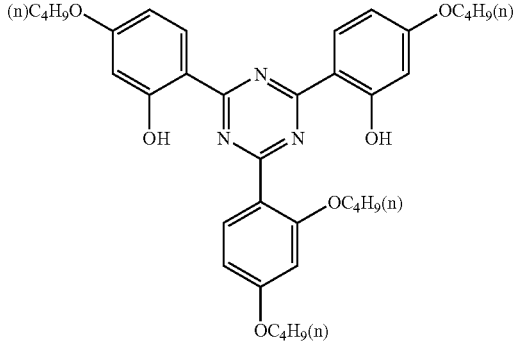

(UV-2)

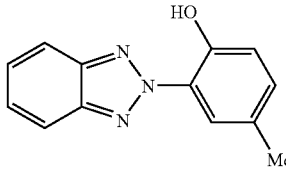

-continued (UV-3)

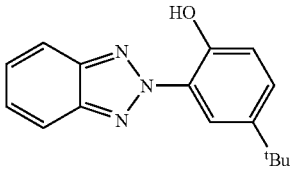

(UV-4)

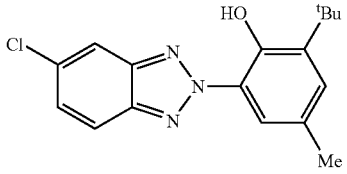

Example 1

Preparation of Support

A pulp slurry was prepared from 50 parts by mass of hardwood bleach kraft pulp (LBKP) of acacia origin and 50 parts by mass of hardwood bleach kraft pulp (LBKP) of aspen origin, by beating these pulps by means of a disk refiner until Canadian standard freeness reached to 300 ml.

Then, to the pulp slurry thus prepared were added, on a pulp basis, 1.3 mass % of cationically-modified starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The thus-prepared pulp slurry was made into paper by use of a fourdrinier paper machine. In a process of drying in which the felt side of web was pressed against a drum dryer cylinder via a dryer canvas, the web thus formed was dried under the condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, followed by drying and further subjecting to calendering treatment. The papermaking was performed so that the raw paper had a grammage (basis weight) of 157 g/m$^2$, and the raw paper (base paper) of thickness 160 μm was obtained.

The wire side (back side) of the base paper obtained was subjected to corona discharge treatment, and thereto a resin composition, in which a high-density polyethylene of MFR (which stands for a melt flow rate, and hereinafter has the same meaning) 16.0 g/10-min and density 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene of MFR 4.0 g/10-min and density 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating would have a dry mass of 0.2 g/m$^2$. Then, the front surface (front side) of the base paper was subjected to corona discharge treatment, and then coated with a low-density polyethylene of MFR 4.0 g/10-min and density 0.93 g/m$^2$, containing 10 mass % of titanium oxide, by means of a melt extruder, so that the coating amount would be 27 g/m$^2$, thereby forming a thermoplastic resin layer with a specular surface.

Preparation of Heat-Sensitive Transfer Image-Receiving Sheet 101 for Comparative Example The support was subjected to corona discharge treatment on the surface thereof, and then a gelatin undercoat layer containing sodium dodecylbenzenesulfonate was disposed on the treated surface. The subbing layer 1, the heat insulation layer 2, the heat insulation layer 1, and the receptor layer 1 each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer 1, the heat insulation layer 2, the heat insulation layer 1, and the receptor layer 1 after drying would be 6.7 g/m$^2$, 7.0 g/m$^2$, 4.8 g/m$^2$ and 2.3 g/m$^2$, respectively.

| | |
|---|---|
| Receptor layer 1-coating liquid | |
| Vinyl chloride-series latex emulsion (trade name: Vinybran 900, MFT >100° C. or more, manufactured by Nisshin Chemicals Co., Ltd.) | 47.0 mass parts |
| Vinyl chloride-series latex emulsion (trade name: Vinybran 609, MFT = 100° C., manufactured by Nisshin Chemicals Co., Ltd.) | 74.5 mass parts |
| Gelatin (16% solution) | 8.4 mass parts |
| The following ester-series wax EW-1 | 4.4 mass parts |
| The following surfactant F-1 | 0.2 mass part |
| The following surfactant W-1 | 0.9 mass part |
| Fluoride oligomer additive (trade name: Megafac F-477, manufactured by Dainippon Ink and Chemicals, Incorporated) | 2.0 mass parts |
| Water | 83.7 mass parts |
| Methanol | 4.5 mass parts |
| NaOH solution for adjusting pH to 7.8 | 0.01 mass parts |
| Heat insulation layer 1-coating liquid | |
| Hollow polymer particles latex emulsion (trade name: MH5055, average particle diameter 500 nm, manufactured by Nippon Zeon Co., Ltd.) | 210.0 mass parts |
| Vinyl chloride-series latex (trade name: Vinybran 609, MFT = 100° C., manufactured by Nisshin Chemicals Co., Ltd.) | 106.9 mass parts |
| Gelatin (16% solution) | 47.2 mass parts |
| Water | 48.9 mass parts |
| NaOH solution for adjusting pH to 8.3 | 0.03 mass part |
| Heat insulation layer 2-coating liquid | |
| Hollow polymer particles latex emulsion (trade name: MH5055, average particle diameter 500 nm, manufactured by Nippon Zeon Co., Ltd.) | 408.6 mass parts |
| Gelatin (16% solution) | 311.1 mass parts |
| Water | 30.0 mass parts |
| NaOH solution for adjusting pH to 7.8 | 0.07 mass part |

-continued

| | |
|---|---|
| Subbing layer 1-coating liquid | |
| Polyvinyl alcohol (trade name: POVAL PVA 205, manufactured by Kuraray) | 5.0 mass parts |
| Methyl methacrylate/butadiene rubber latex emulsion (trade name: MR-171, Tg = −5° C., manufactured by NIPPON A & L INC) | 92.6 mass parts |
| Water | 64.5 mass parts |

(EW-1)

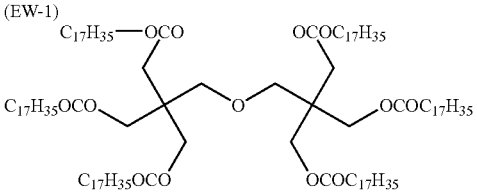

(F-1)

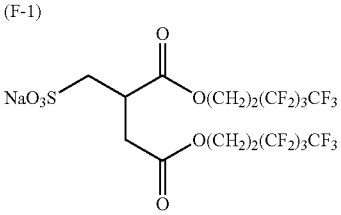

(W-1)

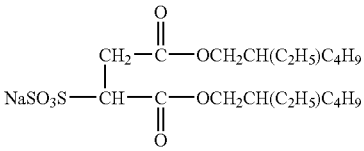

Preparation of Heat-Sensitive Transfer Image-Receiving Sheet 102 for Comparative Example An interlayer-coating liquid and a coating liquid for dye image-receiving layer (receptor layer) in the following compositions were coated on the support thus prepared with a bar coater to a thickness of 4.0 g/m$^2$ and dried temporarily by dryer, and then dried in an oven at 100° C. for 30 minutes, to give a dye image-receiving layer, thus a comparative heat-sensitive transfer image-receiving sheet was obtained.

Composition of Receptor Layer-Coating Liquid:

| | |
|---|---|
| Vinyl chloride/vinyl acetate copolymer (#1000D, tradename, manufactured by DENKI KAGAKU KOGYOU K. K.) | 100 mass parts |
| Amino-modified silicone (X-22-343, tradename, manufactured by Shin-Etsu Chemical Co., Ltd.) | 3 mass parts |
| Epoxy-modified silicone (KF-343, tradename, manufactured by Shin-Etsu Chemical Co., Ltd.) | 3 mass parts |
| Methyl ethyl ketone/toluene (1/1, at mass ratio) | 500 mass parts |

Preparation of Heat-Sensitive Transfer Image-Receiving Sheets 103 to 120

Heat-sensitive transfer image-receiving sheets 103 to 120 were prepared in a manner similar to the heat-sensitive transfer image-receiving sheet 101, except that the additive shown in the following Table 1 was added in the preparation of the heat-sensitive transfer image-receiving sheet 101.

The structure of the additive is shown below.

(Compound A)

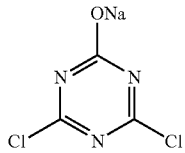

(EMALEX620)

Surfactant manufactured by Nihon-Emulsion Co., Ltd., tradename.

Polyoxyethylene stearyl ether mainly having an ethyleneoxy repeating unit number of 20

CAS No. 9005-00-9

(Image Formation 1)

A black painted image was printed continuously on 20 sheets by using the heat-sensitive transfer sheet and the heat-sensitive transfer image-receiving sheet 101 to 120 in a thermal transfer printer A (ASK-2000, tradename, manufactured by FUJIFILM Corporation), and a gray painted image adjusted to an image density of 1.8 was also printed continuously on 20 sheets. The glossiness of the black painted image and the irregularity in density of the gray painted image on the printed face were evaluated by visual observation. The line speed of the printer A was 0.7 msec/line.

(Measurement of Contact Angle)

The contact angle was measured 2 seconds and 60 seconds after static placement of pure water droplet by using a contact angle analyzer DM500 (tradename, manufactured by Kyowa Interface Science Co., Ltd.) according to the method specified in JIS R 3257.

(Evaluation Methods)

The glossiness of the black painted image was evaluated according to the following criteria.

1: No deterioration in glossiness.

2: Some deterioration in glossiness but without practical problem.

3: Significant deterioration in glossiness causing practical problems.

The browning of the gray painted image was evaluated according to the following criteria.

1: No browning observed.

2: Some browning observed without practical problem.

3: Distinctive browning observed causing practical problems.

TABLE 1

| Image-receiving sheet | | Additive | Added layer | Additive amount (g/m$^2$) | Contact angle (degree) 2 seconds after | Contact angle (degree) 60 seconds after | Glossiness | Browning |
|---|---|---|---|---|---|---|---|---|
| 101 | Comparative example | None | — | — | 70 | 30 | 3 | 3 |
| 102 | Comparative example | None | — | — | 85 | 85 | 3 | 3 |
| 103 | This invention | EMALEX620 | Receptor layer 1 | 0.054 | 68 | 12 | 2 | 2 |
| 104 | This invention | EMALEX620 | Receptor layer 1 | 0.108 | 64 | 10 | 1 | 2 |
| 105 | This invention | EMALEX620 | Receptor layer 1 | 0.162 | 60 | 6 | 1 | 1 |

TABLE 1-continued

| | Image-receiving sheet | Additive | Added layer | Additive amount ($g/m^2$) | Contact angle (degree) 2 seconds after | Contact angle (degree) 60 seconds after | Glossiness | Browning |
|---|---|---|---|---|---|---|---|---|
| 106 | This invention | Compound of the present invention I-17 | Receptor layer 1 | 0.108 | 68 | 19 | 2 | 2 |
| 107 | This invention | I-22 | Receptor layer 1 | 0.054 | 64 | 17 | 2 | 2 |
| 108 | This invention | I-23 | Receptor layer 1 | 0.108 | 62 | 13 | 1 | 1 |
| 109 | This invention | I-24 | Receptor layer 1 | 0.108 | 64 | 15 | 1 | 1 |
| 110 | This invention | I-37 | Receptor layer 1 | 0.108 | 66 | 15 | 1 | 2 |
| 111 | This invention | I-45 | Receptor layer 1 | 0.162 | 67 | 17 | 2 | 2 |
| 112 | This invention | NaCl | Receptor layer 1 | 0.076 | 60 | 22 | 2 | 2 |
| 113 | This invention | NaCl | Receptor layer 1 | 0.152 | 55 | 17 | 2 | 2 |
| 114 | This invention | NaCl | Receptor layer 1 | 0.228 | 50 | 12 | 1 | 2 |
| 115 | This invention | KCl | Receptor layer 1 | 0.097 | 60 | 22 | 2 | 2 |
| 116 | This invention | KCl | Receptor layer 1 | 0.194 | 55 | 17 | 1 | 2 |
| 117 | This invention | KCl | Receptor layer 1 | 0.291 | 50 | 12 | 1 | 1 |
| 118 | This invention | LiCl | Receptor layer 1 | 0.055 | 60 | 22 | 2 | 2 |
| 119 | This invention | LiCl | Receptor layer 1 | 0.110 | 55 | 17 | 2 | 2 |
| 120 | This invention | LiCl | Receptor layer 1 | 0.165 | 50 | 12 | 1 | 2 |

As obvious from Table 1 above, all heat-sensitive transfer image-receiving sheets according to the present invention were superior in properties and resistant to deterioration in glossiness in higher-density region of image even if the image was printed under high-humidity environment.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-016964 filed in Japan on Jan. 28, 2008, which is entirely herein incorporated by reference.

What we claim is:

1. A heat-sensitive transfer image-receiving sheet, comprising a support and an interlayer, an insulation layer and a receptor layer formed on the support in that order, wherein the receptor layer contains at least one kind of latex polymer and a compound represented by the following Formula (I) or an inorganic salt selected from the group consisting of halides, sulfate compounds and nitrate compounds of alkali metals, and the contact angle between the receptor layer surface and water 2 seconds after placement of water droplet, as determined by the static droplet method specified in JIS R-3257, is 68° or less or the contact angle 60 seconds after placement of water droplet is 28° or less, $$R—(OCH_2CH_2)_n—OH \qquad \text{Formula (I)}$$

wherein, R represents an alkyl or alkenyl group having 4 to 30 carbon atoms, and n is an integer of 10 to 30, and wherein the latex polymer is one or at least two kinds of latex polymer selected from the group consisting of vinyl chloride/acrylic compound latex copolymers, vinyl chloride/vinyl acetate latex copolymers, and vinyl chloride/vinyl acetate/acrylic compound latex copolymers.

2. The heat-sensitive transfer image-receiving sheet according to claim 1, wherein the contact angle 2 seconds after placement of water droplet is 68° or less and the contact angle 60 seconds after placement of water droplet is 28° or less.

3. The heat-sensitive transfer image-receiving sheet according to claim 1, wherein the receptor layer contains the compound represented by the formula (I).

4. The heat-sensitive transfer image-receiving sheet according to claim 1, comprising the compound represented by the formula (I) in an amount of 0.03 $g/m^2$ to 0.3 $g/m^2$.

5. The heat-sensitive transfer image-receiving sheet according to claim 1, wherein the receptor layer contains the inorganic salt.

6. The heat-sensitive transfer image-receiving sheet according to claim 1, wherein the inorganic salt is contained in an amount of 0.01 $g/m^2$ to 0.9 $g/m^2$.

7. The heat-sensitive transfer image-receiving sheet according to claim 1, wherein the heat insulation layer contains at least one kind of hollow polymeric particles.

8. The heat-sensitive transfer image-receiving sheet according to claim 1, wherein the interlayer contains a water-soluble polymer other than gelatin.

9. The heat-sensitive transfer image-receiving sheet according to claim 1, wherein the heat insulation layer contains at least one kind of hollow polymeric particles, and the heat-sensitive transfer image-receiving sheet is formed by simultaneous multilayer coating of the interlayer, the heat insulation layer and the receptor layer.

* * * * *